US005928118A

United States Patent [19]

Rosenthal

[11] Patent Number: 5,928,118

[45] Date of Patent: Jul. 27, 1999

[54] LUMBAR STABILIZATION EXERCISE APPARATUS

[76] Inventor: Dean A. Rosenthal, 6819 Pittsford-Palmyra Rd., Fairport, N.Y. 14450

[21] Appl. No.: 09/076,077

[22] Filed: May 11, 1998

[51] Int. Cl.[6] ..... A63B 21/00; A63B 21/16

[52] U.S. Cl. ..... 482/99; 482/133; 482/142

[58] Field of Search ..... 482/56, 94–97, 482/99, 102, 103, 112, 113, 120, 130, 133, 138, 148, 908

[56] References Cited

U.S. PATENT DOCUMENTS

| | | | |
|---|---|---|---|
| 2,472,391 | 6/1949 | Albizu | 482/99 |
| 4,531,730 | 7/1985 | Chenera | 482/142 |
| 5,163,890 | 11/1992 | Perry, Jr. | 482/142 |
| 5,795,272 | 8/1998 | Brenke | 482/103 |

*Primary Examiner*—Richard J. Apley
*Assistant Examiner*—John Mulcahy
*Attorney, Agent, or Firm*—William Greener

[57] ABSTRACT

An exercise apparatus includes a base and a bench supported above the base by a support structure interconnecting the base and a center section of the bench. The bench includes one wing section attached to a side of the center section in a manner that allows fixing the one wing section in a range of discreet positions from about 15 degrees above to 90 degrees below a horizontal plane of the center section, and another wing section attached to an opposite side of the center section in a similar manner. Each wing section has a lengthwise slotted opening located between an edge and a longitudinal centerline of the wing section. The apparatus is further equipped with a set of variable resistances connected to a set of handles by a set of cords that run over a set of fixed and movable guides. An end of each cord passes through a slot in each wing section.

8 Claims, 2 Drawing Sheets

(SIDE VIEW)

LUMBAR STABILIZATION EXERCISE APPARATUS

BACKGROUND OF THE INVENTION

FIELD OF THE INVENTION

The invention generally relates to an exercise machine, and in particular to an exercise apparatus that is directed to strengthening the lumbar and abdominal regions of the user, and which apparatus has a high degree of adaptability for performing a variety of exercises.

There are many types of exercise machines available for home and commercial use. They may be specifically directed to a particular exercise or may be utilized to perform different exercises, or to work on different parts of the user's body. Certain exercise machines allow a person to carry out preselected exercises to condition and strengthen, e.g., a weak back. However, due to the construction of such devices, they may contribute to greater stress or force being applied to a particularly sensitive part of the body; i.e., the part that the exercise is intended to strengthen.

An exercise regime known as the Dynamic Lumbar Stabilization Program is widely acknowledged as standard therapy for low back disorders. The program emphasizes pelvic stabilization techniques during abdominal and low back strengthening exercises. Once a patient has attained a level of ability of sets and repetitions of defined exercise, the program is advanced by increasing the resistance forces of each exercise. Such progressive resistance exercises allow a faster increase in muscle strengthening. Also, measured weights provide a defined means to increase resistance, which allows a known quantity of effort to be exerted. The progressive resistance referred to is typically provided by a barbell plate or dumbbell, and often, ankle and wrist weights. However, the amount of weight that can be loaded into a wrist or ankle weight holder, for example, becomes limiting; while changing the weight amount in these devices is cumbersome. Moreover, the ankle and wrist weight holders are not intended to be shared as they are difficult to disinfect between users. Thus, the exercise carried out in the Program are effective only up to a certain point.

In light of the foregoing, there is a need for an exercise apparatus that provides a degree of flexibility in its construction and use and which accommodates a wide variation of users' anatomies and exercise requirements, and which addresses the issues described above.

SUMMARY OF THE INVENTION

Accordingly, the invention is directed to an apparatus providing such features. Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention describes an exercise apparatus that includes a bench supported above a base by a support structure. The bench has two wing sections, e.g., a head and leg wing, connected to opposite ends of a center section by hardware that allows the wing sections to be positioned in planes at various angles with respect to the horizontal plane of the center section. In particular, either wing section can be inclined upwards to about 15° above the horizontal or downwards to about 90° below the horizontal, and fixed in position anywhere within these ranges. Four progressive resistance apparatii are positioned in quadrature below the center section of the bench, and four sets of series of fixed and moveable/fixable guides, e.g., pulleys, direct respectively, four cords which are each attached at one end to the resistance, and at or near the other end to a handle, e.g. a hand grip. The handle is located above the bench for pulling upwards, which is accommodated by lengthwise slots in each wing section of the bench. As such, each cord passes through a respective slot before engaging the handle. The slots allow space for the cord to pass through the wing section regardless of the orientation of the wing section.

The combination of progressive resistance provided, e.g. by sets of weights, adjustable springs or stretchable resilient components, and the selective orientation of each wing section with respect to the stationary center section, provides an apparatus having the features and advantages described above. In an aspect of the invention, the handles may comprise hand grips, leg (ankle) attachments, and/or special head, neck and abdominal yokes utilizing a Velcro® type adjustment, for example, or other conventional adjustments. The handles will preferably provide for adjusting the length of the cord engaging the handle. For example, a hand grip could tighten/loosen around a cord by a twisting motion to engage a chuck type mechanism.

It will be appreciated, especially with reference to FIG. 1, that the components of the apparatus including the resistance, cords, handles, slots, and guides are symmetrically arranged in quadrature; i.e., one cord is connected to one resistance and one handle, is guided by one set of guides, and passes through one slot in a wing section. Accordingly, the invention is generally described with reference to only one of the four identical combinations of components; however, it is to be understood that the description applies to the entire apparatus.

In an embodiment of the invention, a first cord guide is fixedly located below a top surface of the bench above the resistance means, a second guide is fixedly located below the top surface of the bench next to the first guide; a third guide is fixedly located in the base next to the resistance means, and movably located in the base and is fixable in a desired location.

In an aspect of the invention, both fourth cord guide means cooperatively associated with a respective wing section may be interconnected by a rigid member so that they can be positioned and locked in place evenly with respect to each other.

The apparatus further includes a first guide means for guiding a cord, that is fixedly connected to the apparatus below a top surface of the bench, a second guide means for guiding the cord, fixedly connected to the apparatus below the top surface of the bench; a third guide means for guiding the cord, fixedly connected to the apparatus below a top surface of the bench, a fourth guide means for guiding the cord, movably connected to the apparatus below a top surface of the bench and fixable in a desired location; a resistance means for providing a variable resistance force, F, connected to a first end of the cord and cooperatively engaging the base; and a means for engaging the resistance force via the user, connected to the cord near a second end thereof after the second end of the cord is passed through the slotted opening, cooperatively engaging a top surface of the bench.

In an aspect of the invention, the bench consists of three sections; a center section, one wing section on one side of the center section, and another wing section on the opposite side of the center section. The wing sections each have a pair of lengthwise slotted openings, one opening each located between a longitudinal centerline and an edge of the bench. The wing sections are attached to the center section by positioning means that allow each wing section to independently be set and fixed in an angular position with respect to the horizontal plane of the center section; e.g. from about 15° above to 90° below the horizontal plane of the bench. Accordingly, the positioning means may include, but are not limited to, e.g., a hinge and locking assembly such as a rigid, multi-apertured template with locking pin, or a locking hinge.

The engaging means described above are intended to be grasped by the user's hands, attached to the wrists and/or ankles of the user, strapped to the user's head, legs, thighs, etc. and therefore take the form of ergonomically designed engaging and/or straps. When the handle means are engaged by the user's hands and/or legs (i.e., two appendages each), there will be four engaging means each cooperatively engaging one of the four slotted openings in the wing sections of the bench. It will be appreciated then that there will be four sets of guide means for guiding four cords in their paths from four respective resistance means, through their respective slotted openings and attached to their respective engaging means. In this case, the cord, guide means, engaging means and resistance means will be in quadrature, symmetrically laid out in the apparatus. In the case where the user is exercising his/her neck, for example, the engaging means may be a single strap or harness that fits around the user's head; however, the cord, guide and resistance means will still be in quadrature arrangement in the apparatus. In an aspect of the invention, the engaging means will allow the length of the cord attached thereto to be adjusted to compensate for the extra length when the wing sections of the bench are tilted upwards or downwards.

The resistance means can include a stack of weights in a guide with a pin for selecting a desired weight, a variety of spring mechanisms such as coiled or wound, for example, which are adjustable as to the amount of tension they provide, or a resilient, elastomeric material or combination thereof.

The guide means can be pulleys, rollers, wheels or other suitable surfaces that guides the cord with little friction.

In an aspect of the invention, the first guide means is fixed in positioned substantially above the resistance means; the second guide means is fixed in positioned laterally adjacent the first guide means; the third guide means is fixed in positioned laterally adjacent the resistance means; and the fourth guide means is adjacent the third guide means but is movable in a line corresponding to the respective slotted opening in the bench and fixable in position. Since the most efficient force transfer occurs when the section of cord from the fourth guide means to the handle is generally perpendicular to the plane of the respective wing section, it will be appreciated that when the wing section is tilted downward, the fourth guide means will be in a location closer to the third guide means, and conversely, when the wing section is tilted upwardly, the fourth guide means will be in a location farther from the third guide means.

It is to be understood that both the foregoing general description and the following detailed description are exemplary and are intended to provide further explanation of the invention as claimed.

The accompanying drawings are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
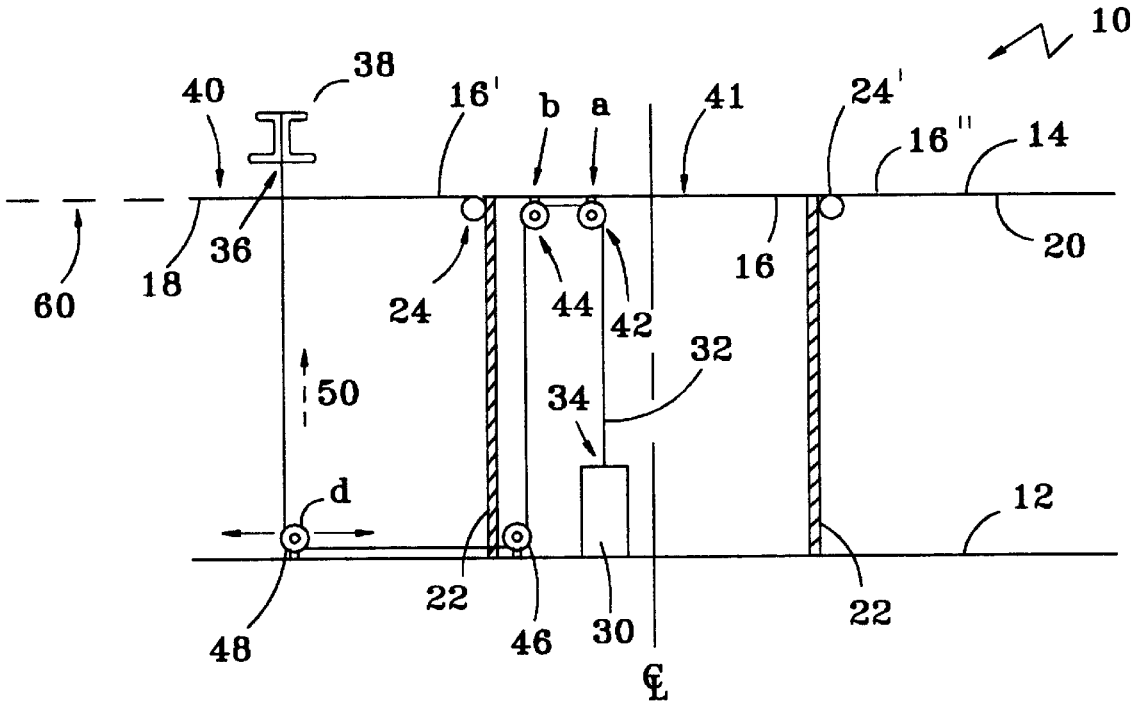
FIG. 1 is an elevation view of an embodiment of the invention showing a quadrant of the components of the apparatus.
Figure 2:
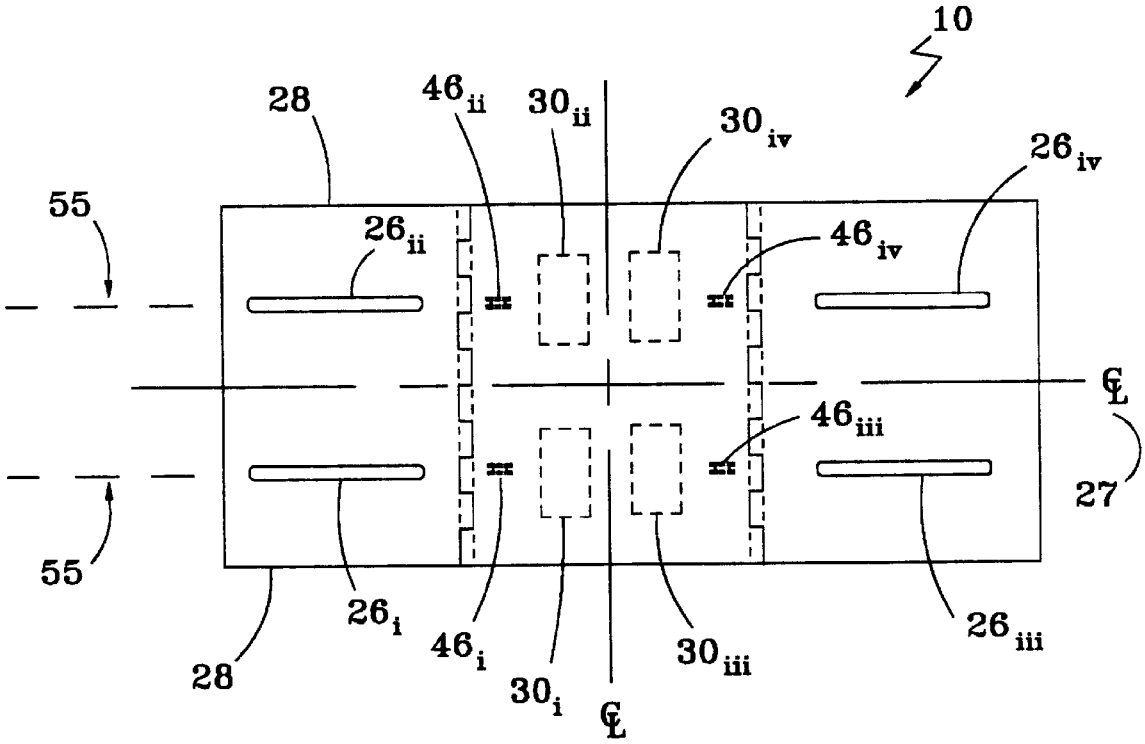
FIG. 2 is a top plan view of an embodiment of the invention.
Figure 4:
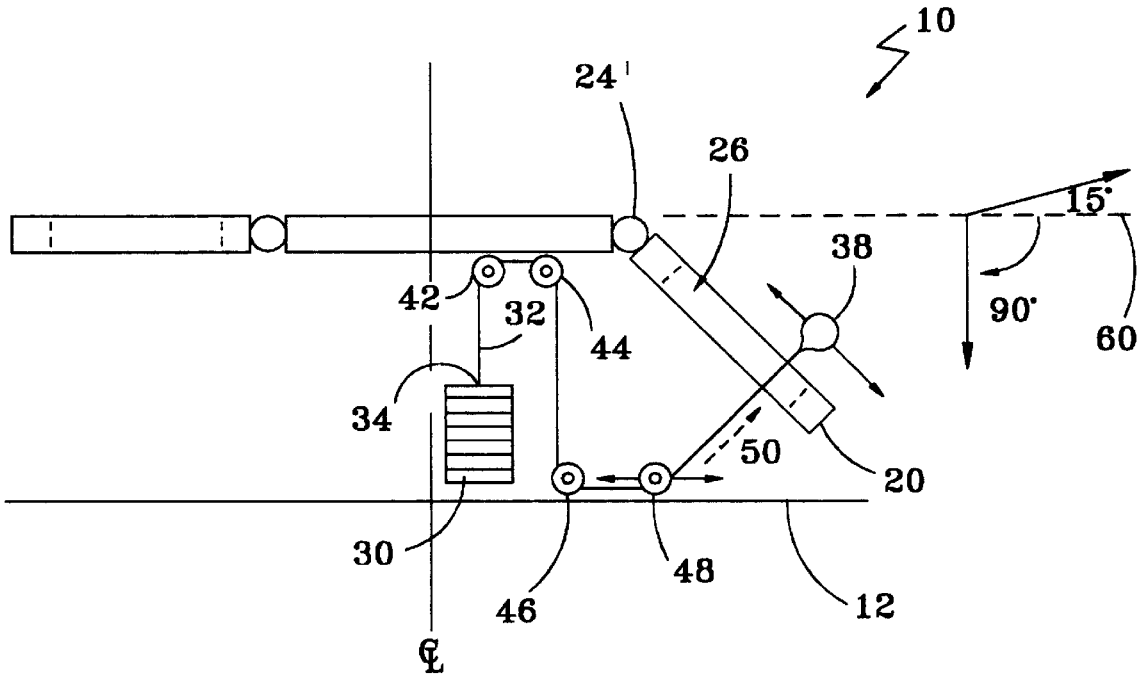
FIG. 4 is an elevation view of an embodiment of the invention that illustrates an exemplary configuration of the apparatus.

Referring to the figures, the apparatus 10 of the present invention has a base 12 which supports the apparatus, and a bench 14 supported above the base by a support structure 22 as shown in FIG. 1. The bench 14 includes a center section 16, one wing section 18 and another wing section 20. Wing section 18 is attached to one side 16' of the center section by a positioning means 24 for providing rotational or pivotal movement of, and fixable positioning of, the wing section at an angle in the range from about 15° above to 90° below the horizontal plane of the bench shown by reference numeral 60 in FIG. 4. As such, positioning means 24 typically includes a locking or non-locking hinge mechanism, ratchet mechanism, a rigid template having holes or slots in combination with a locking bar, rod or pin, or other suitable mechanism that allows the wing section to be positioned in a cantilever fashion with respect to the plane 60 of the center section 16 in the range mentioned above. Similar positioning means 24' are provided for attaching and positioning the other wing section 20 to the opposite side 16" of the center section 16. Referring to FIG. 2, each wing section 18, 20 has a respective pair of elongate slotted openings $\mathbf{26}_{i}$, $\mathbf{26}_{ii}$; $\mathbf{26}_{iii}$, $\mathbf{27}_{iv}$ that extend longitudinally along axes 55. Each slotted opening 26 is located in a wing section intermediate a longitudinal centerline 27 of the bench and an edge 28 of the bench.

Referring again to FIG. 1, a resistance means 30 for providing a variable or progressive resistance force F, is shown in cooperative engagement with base 12; that is, means 30 may be a variable resistance coil or wound spring attached to base 12 (not shown), a set of weights on a holder with a pin or bar for selecting a variable weight which would lift off of the base, a stretchable elastomeric device, or other structure capable of providing a variable settable tensile force through the cord 32.

A first end 34 of the cord 32 is attached to the resistance means. The cord 32 is guided in a path as shown from the resistance means 30 over a series of first, second, third and fourth cord guide means 42, 44, 46, 48, and through slotted opening 26 where a second end or section 36 of cord 32 attaches to an engaging means 38. The engaging means 38 are straps, yokes, grippable handles or the like having a form to accommodate engagement by a person's hand, wrist, leg, head, arm, abdomen or other part of the body where the pulling force is desired. Preferably, the engaging means 38 will provide adjustment for the length of the cord attached to it to accommodate for slack in the cord due to different positions of the wing section of the bench. The adjustment may be in the form of a twisting chuck-like mechanism in a grippable handle, for example, a wedge piece to engage an opening in the handle through which the cord passes, or other suitable arrangement for preventing slippage of the cord in the handle means.

Figure 3:
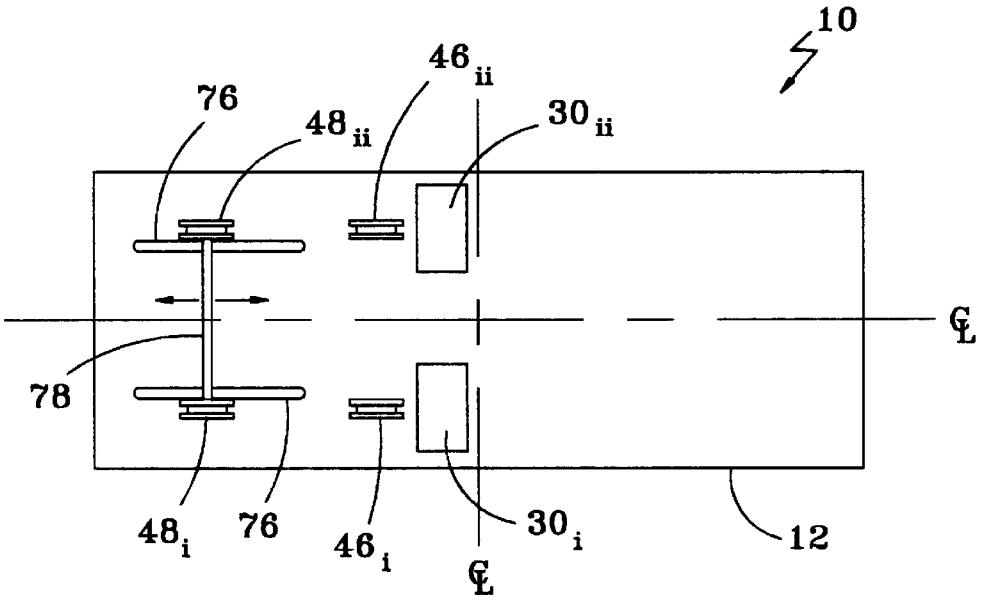
FIG. 3 is a top plan view of the base of an embodiment of the invention.

The guide means 43, 44, 46, 48 for guiding the cord can be pulleys, rollers, wheels, or other suitable surfaces which allow the cord to travel in the guide path with reduced friction. A first guide means 42 is fixedly attached to a bottom surface 41 of the bench center section 16 at location (a), approximately directly above the resistance means 30. A second guide means 44 is similarly fixedly attached at (b) and laterally displaced from first guide means 42. A third guide means 46 is fixedly attached to the base 12 at (c) approximately directly below second guide means 44. A fourth guide means 48 is moveably attached to base 12 at (d), and can be fixed in position in the base corresponding to the slotted opening 26 and the position of engaging means 38 along the slot. In a preferred embodiment as shown in FIG. 3., fourth guide means 48 is located on a rail portion 76 of base 12.

As an illustrative example, a shorter legged person seated on the center section of the bench, wishing to do a leg lift exercise, would preferably position fourth guide means 48 nearer to 3rd guide means 46 than a longer legged person. Engaging means 38 would preferably be an ankle strap whose position along slotted opening 26, in combination with the position of guide 48, would provide that the cord section between guide 48 and handle 38 remains substantially perpendicular to the plane of wing section 18 as illustrated by 50 in FIG. 4. It will be further appreciated that as the wing section is titled downward and fixed in a position between 0–90° below the horizontal 60, or titled upward and fixed in a position between 0–15° above the horizontal, the location of guide 48 will be moved in or out, respectively, to maintain a substantially perpendicular orientation of the cord direction 50 to the tilted wing section of the bench. Thus the slotted opening 26 allows the handle 38 to be relatively located at an appropriate location along the slot. As shown, handle 38 has a shape and/or size sufficient to prevent it from passing through the slotted opening. In operation, as the handle is lifted above the bench, the cord 32 engages the resistance means 30 providing a resistance force, F, to the user.

For simplicity, only one quadrant of the resistance means, guide means and handle means has been shown in the Figures described in detail. It is to be understood, however, that the apparatus 10 employs four symmetric sets of resistance, guide and handle means, which are identical with the exception of the form of the engaging means; that is, one each, e.g., left leg, right leg, left arm, right arm. Thus each wing section 18, 20 has a pair of parallel slotted openings $\mathbf{26}_{i\text{-}iv}$ as shown in FIG. 2. Resistance means $\mathbf{30}_{i\text{-}iv}$, third guide means $\mathbf{46}_{i\text{-}iv}$ are schematically shown in dotted lines in FIG. 2 while third guide means $\mathbf{46}_{i\text{-}ii}$ and fourth guide means $\mathbf{48}_{i\text{-}ii}$ are illustrated in FIG. 3.

In an alternative aspect of the invention a connecting piece 78, in the form of a rigid member, for example, is attached to both sets of fourth guide means $\mathbf{48}_{i}$, $\mathbf{48}_{ii}$, to allow these guide means to be moved and positioned in unison. For convenience, their locations can be noted by indicia in the base.

Although the invention has been described in relation to a particular embodiment thereof, those skilled in the art will appreciate that variations and modifications to the invention are within the scope of the invention which is limited only by the appended claims.

I claim:

1. An exercise apparatus, comprising:

a) a base;

b) a bench having a center section and a pair of wing sections attached to opposite sides of the center section by positioning means for fixedly positioning each wing section in a range of positions between about 15 degrees above to 90 degrees below a horizontal top surface of the center section, at least one of the wing sections having a lengthwise slotted opening;

c) a support structure interconnecting the base and the bench;

d) a cord having first and second ends;

e) first guide means for guiding the cord, fixedly connected to the apparatus below the top surface of the bench in a first location;

f) second guide means for guiding the cord, fixedly connected to the apparatus below the top surface of the bench in a second location;

g) third guide means for guiding the cord, fixedly connected to the apparatus below the top surface of the bench in a third location;

h) fourth guide means for guiding the cord, movably connected to the apparatus below the top surface of the bench and fixable in a fourth location;

i) resistance means for providing a variable resistance force connected to the first end of the cord; and i) means for engaging the resistance force, connected to the cord near the second end thereof after the second end of the cord is passed through the slotted opening, and cooperatively engaging the top surface of the bench.

2. The apparatus of claim 1, comprising four lengthwise slotted openings, a set of four first guide means, a set of four second guide means, a set of four third guide means, a set of four fourth guide means, a set of four resistance means, a plurality of handle means, and a set of four cords respectively interconnecting the handle means and the resistance means, all said means arranged in quadrature.

3. The apparatus of claim 1, wherein the slotted opening is located intermediate a longitudinal centerline of the bench and an edge of the bench.

4. The apparatus of claim 1, wherein the first and second guide means are connected to a bottom side of the bench, and the third and fourth guide means are connected to the base.

5. The apparatus of claim 1, wherein the first guide means is connected to a bottom side of the bench at a location substantially directly above the resistance means, the second guide means is connected to the bottom side of the bench at a location substantially longitudinally adjacent the first guide means, the third guide means is connected to the base at a location substantially directly below the second guide means, and the fourth guide means is connected to the base at a location substantially directly below and aligned with the slotted opening.

6. The apparatus of claim 1, wherein the cord is adjustably attached to the engaging means for adjustment of the effective length of the cord.

7. An exercise apparatus, comprising:

a) a base;

b) a support structure interconnecting the base and a bench, wherein the bench includes one wing section having a pair of lengthwise slotted openings, adjustably attached to a side of a center section of the bench by positioning means for supporting the one wing section in a range of discreet positions from about 15 degrees above to 90 degrees below a horizontal plane of the center section, and another wing section having a pair of lengthwise slotted openings, adjustably attached to an opposite side of the center section of the bench by positioning means for supporting the other wing section in a range of discreet positions from about 15 degrees above to 90 degrees below the horizontal plane of the center section;

c) a set of four first guide means for respectively guiding a set of four cords, fixedly attached in quadrature to a bottom side of the bench;

c) a set of four second guide means for respectively guiding the set of four cords, fixedly attached in quadrature to the bottom side of the bench;

d) a set of four third guide means for respectively guiding the set of four cords, fixedly attached in quadrature to the base;

e) a set of four fourth guide means for respectively guiding the set of four cords, movably attached in quadrature to the base and fixable in a selected position;

f) a set of four resistance means for providing four respective variable resistance forces, each of which is attached to a first end of one of the four cords; and g) for engaging the resistance means means adjustably attached to the cords after a second end of the respective cord is passed through a respective slotted opening.

8. An exercise apparatus, comprising:

a) a base;

b) a bench including a center section supported above the base by a support structure interconnecting the base and the center section of the bench, one wing section attached to a side of the center section by positioning means for fixing the one wing section in a range of discreet positions from about 15 degrees above to 90 degrees below a horizontal plane of the center section, and another wing section attached to an opposite side of the center section of the bench by positioning means for supporting the other wing section in a range of discreet positions from about 15 degrees above to 90 degrees below the horizontal plane of the center section, each wing section having a lengthwise slotted opening located intermediate an edge and a longitudinal centerline of the wing section;

c) resistance means for providing a variable resistance force substantially below the center section of the bench;

d) a cord having a first end attached to the resistance means and a second end passing through one said slotted opening, and attached to a means for engaging the resistance means;

e) guide means for guiding the cord in a path from the resistance means to the engaging means, comprising first guide means fixedly connected to the apparatus below a top surface of the bench in a first location, second guide means fixedly connected to the apparatus below the top surface of the bench in a second location, third guide means fixedly connected to the apparatus below a top surface of the bench in a third location, and fourth guide means movably connected to the apparatus below a top surface of the bench and fixable in a fourth location.

* * * * *